US008650902B2

(12) United States Patent
Shin

(10) Patent No.: US 8,650,902 B2
(45) Date of Patent: Feb. 18, 2014

(54) DISPENSER FOR REFRIGERATOR AND REFRIGERATOR INCLUDING THE SAME

(75) Inventor: Taeyoung Shin, Gyeongnam (KR)

(73) Assignee: LG Electronics Inc., Seoul (KR)

( * ) Notice: Subject to any disclaimer, the term of this patent is extended or adjusted under 35 U.S.C. 154(b) by 338 days.

(21) Appl. No.: 13/185,758

(22) Filed: Jul. 19, 2011

(65) Prior Publication Data

US 2012/0017629 A1 Jan. 26, 2012

(30) Foreign Application Priority Data

Jul. 20, 2010 (KR) ..... 10-2010-0069778

(51) Int. Cl.
*F25D 3/04* (2006.01)
*B67D 7/82* (2010.01)

(52) U.S. Cl.
USPC ..... 62/389; 222/146.1

(58) Field of Classification Search
USPC ..... 62/389, 377; 222/146.1, 146.6; 141/351, 360, 362
See application file for complete search history.

(56) References Cited

U.S. PATENT DOCUMENTS

| | | | | |
|---|---|---|---|---|
| 2,795,639 | A * | 6/1957 | Rawson | 174/535 |
| 2,847,653 | A * | 8/1958 | Hicks | 439/332 |
| 3,487,200 | A * | 12/1969 | Laama et al. | 219/437 |
| 4,308,724 | A | 1/1982 | La Ginestra | |
| 6,183,280 | B1 * | 2/2001 | Laukhuf | 439/214 |
| 2006/0090427 | A1 * | 5/2006 | Hau et al. | 53/512 |
| 2007/0023451 | A1 * | 2/2007 | Bordino | 222/146.5 |
| 2007/0209522 | A1 * | 9/2007 | Bigge et al. | 99/279 |
| 2008/0164796 | A1 * | 7/2008 | McCoy et al. | 312/405 |
| 2008/0222327 | A1 | 9/2008 | McCoy et al. | |

FOREIGN PATENT DOCUMENTS

| | | | |
|---|---|---|---|
| CN | 1683893 | A | 10/2005 |
| CN | 201174458 | Y | 12/2008 |
| DE | 20 2009 014551 | U1 | 5/2010 |
| EP | 2 037 197 | A2 | 3/2009 |

OTHER PUBLICATIONS

Chinese Office Action dated Jul. 9, 2013 for Application No. 201110243409.2, with English Translation, 16 pages.

* cited by examiner

*Primary Examiner* — Allana Lewin
*Assistant Examiner* — Kristin Oswald
(74) *Attorney, Agent, or Firm* — Fish & Richardson P.C.

(57) ABSTRACT

A dispenser for a refrigerator and a refrigerator including the same are disclosed. The refrigerator includes a cabinet comprising a storage compartment; a door rotatably provided in the cabinet; and a dispenser provided in the door to supply water outside the door, the dispenser comprising a power supply part which is able to be connected with an external device containing predetermined liquid, to supply an electric power to the external device.

6 Claims, 5 Drawing Sheets

DISPENSER FOR REFRIGERATOR AND REFRIGERATOR INCLUDING THE SAME

CROSS REFERENCE TO RELATED APPLICATION

This application claims the benefit of the Patent Korean Application No. 10-2010-0069778, filed on Jul. 20, 2010, which is hereby incorporated by reference as if fully set forth herein.

BACKGROUND OF THE DISCLOSURE

1. Field of the Disclosure

The present invention relates to a dispenser for a refrigerator and a refrigerator including the same, more particularly, to a refrigerator including a dispenser which can supply an electric power to an external device, to enhance user convenience.

2. Discussion of the Related Art

A refrigerator is an electric appliance which can maintain freshness of various foods for a long time by supplying cold air generated by a freezing cycle to a freezer compartment and a refrigerator compartment.

In general, such a refrigerator includes a cabinet having a freezer compartment and a refrigerator compartment formed therein to store foods, and doors coupled to sides of the cabinet to open and close the freezer and compartment compartments, respectively.

In addition, elements including a compressor, an evaporator, an expansion valve and the like which compose the freezing cycle may be provided in the cabinet. Cold air generated from the evaporator is supplied to the freezer and refrigerator compartments, to preserve stored food in the freezer and refrigerator compartments at a low temperature for a long time period.

In recent, a dispenser is installed in the door of the refrigerator to allow a user to dispense water or ice cubes from a water supply or an ice maker provided in the refrigerator conveniently even without opening the door. Also, cold air inside the refrigerator compartment or the freezer compartment cannot be prevented from losing although the door is opened or closed frequently.

However, the refrigerator includes only the dispenser simply in consideration of use convenience and it has a disadvantage of failing to satisfy a variety of user's demands sufficiently, while conventional electric appliances create new values via convergence with multimedia devices.

In other words, the dispenser provided in the refrigerator is used to dispense cold water cooled by cold air inside the refrigerator. In case hot water to make coffee is needed, the water dispensed from the dispenser is poured into a coffee pot and the coffee pot is connected with a power supply additionally provided, to boil the water inconveniently.

Such the inconvenience might be generated because a power supply used to supply the electric power to a boiling container such as a coffee pot is not provided in the dispenser capable of supplying cold water.

SUMMARY OF THE DISCLOSURE

An object of the present invention is to provide a refrigerator including a dispenser.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings. To achieve these objects and other advantages and in accordance with the purpose of the invention, as embodied and broadly described herein, a refrigerator includes a cabinet comprising a storage compartment; a door rotatably provided in the cabinet; and a dispenser provided in the door to supply water outside the door, the dispenser comprising a power supply part which is able to be connected with an external device containing predetermined liquid, to supply an electric power to the external device.

In another aspect of the present invention, a dispenser for a refrigerator includes a dispenser case provided in a door of the refrigerator; a supply part provided in the dispenser case to supply ice or water; an opening/closing switch provided in the dispenser case to allow the ice or the water dispensed outside selectively; and a power supply part provided in a lower portion inside the dispenser case, the power supply part which is able to be connected with an external device containing predetermined liquid, to supply an electric power to the external device.

According to the present invention, there may be advantages as follows. The power supply part configured to supply the electric power to the external device is independently provided in the dispenser provided in the door of the refrigerator. Because of that, when he or she needs hot water to drink coffee or the like, the user can directly connect the external device such as a coffee pot with the power supply part provided in the dispenser to get the hot water.

In other words, the dispenser provided in the refrigerator according to the present invention may supply not only cold water but also hot water smoothly, because it includes the power supply part. As a result, the conventional inconvenience of using an additional power supply to connect a coffee pot when the user needs hot water, while using the dispenser when needing cold water, may be solved.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure.

In the drawings.

DESCRIPTION OF SPECIFIC EMBODIMENTS

Figure 1:
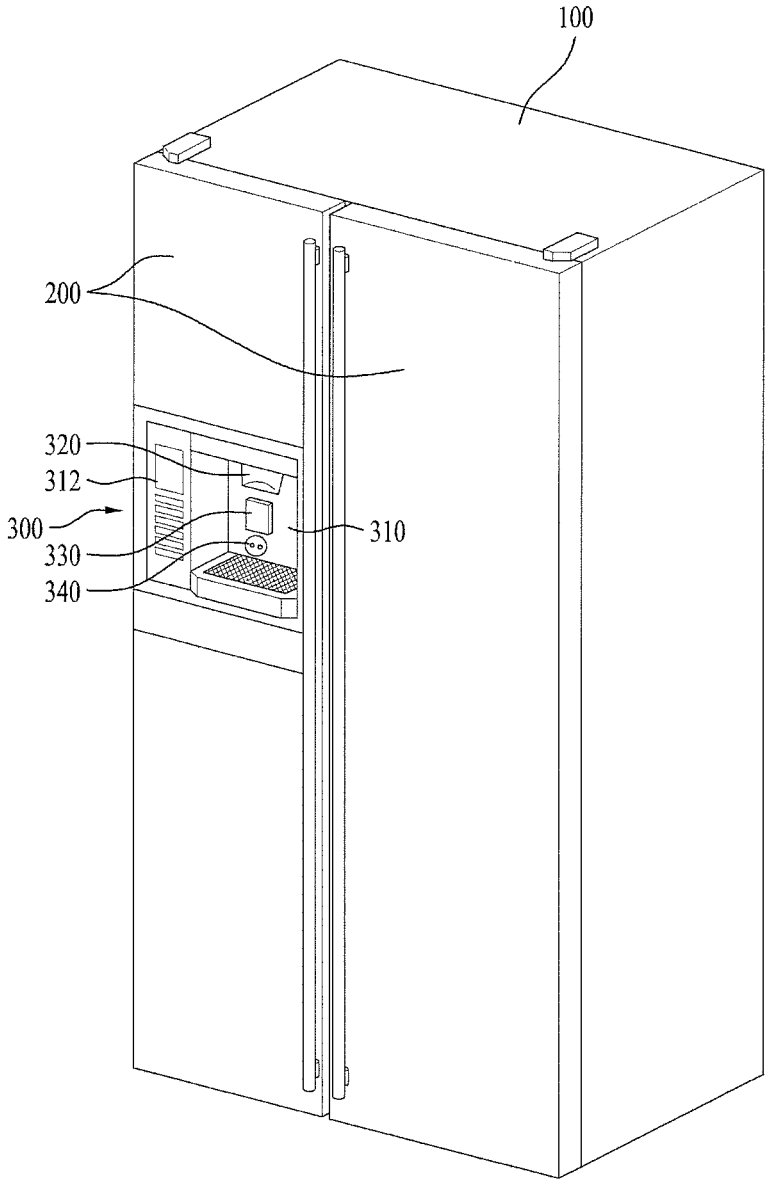
FIG. 1 is a perspective view illustrating a refrigerator including a dispenser according to an embodiment of the present invention.

As follows, embodiments of the present invention will be described in detail in reference to the accompanying drawings. Sizes and appearances of elements shown in the drawings may be exaggerated for simplicity and convenience of description. In addition, terms specially defined in consideration of configuration and practice of the present invention may be modified by users, intensions of the users or practices. Definition of the terms may be made based on contents disclosed in the present specification.

Technical features of the present invention are not limited by the embodiments which will be proposed as follows. People skilled in the art who understand the technical feature of the present invention may expect other embodiments within a scope of the technical feature easily and those embodiments belong to the scope of the present invention.

FIG. 1 is a perspective view illustrating a refrigerator including a dispenser 300 according to an embodiment of the present invention. In reference to FIG. 1, a basic structure of the refrigerator according to the present invention will be described in detail.

As shown in FIG. 1, an exterior appearance of the refrigerator is defined by a cabinet 100 formed in an approximately cube shape.

A storage compartment which is a room for storing foods and the like is formed in the cabinet 100. The storage compartment is partitioned into right and left parts by a barrier (not shown) provided in the cabinet 100, such that freezer and refrigerator compartments may be provided.

According to a type of the refrigerator, the barrier may partition the storage compartment 110 of the cabinet 100 into top and bottom parts to provide the freezer and refrigerator compartments. The present invention may be applicable to various types of refrigerators, not limited thereby.

In the meanwhile, a front of the cabinet 100 is formed open and doors 200 are rotatably coupled to the open front of the cabinet 100. The doors 200 are configured to open and close the open front of the cabinet 100, in other words, the freezer and refrigerator compartments selectively.

The door 200 may be configured to open and close the freezer and refrigerator compartments and they may open and close the freezer and refrigerator compartments independently by rotating along both directions.

In the meanwhile, a dispenser 300 is provided in a front surface of the door 200 configured to open and close the freezer or refrigerator compartment. The dispenser 300 allows purified water or ice to be dispensed outside. Specifically, the ice made in an ice maker (not shown) and the water purified in a water purifier (not shown), which are provided in the freezer or refrigerator compartment, may be dispensed outside via the dispenser 300.

Figure 2:
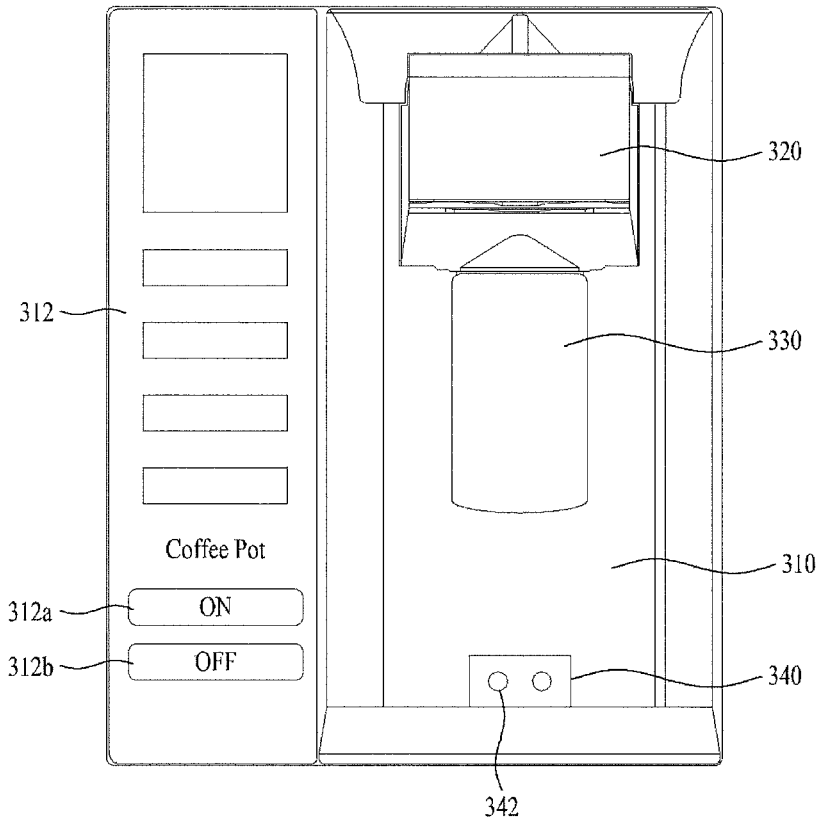
FIG. 2 is a front view illustrating a dispenser according to an embodiment of the present invention.

FIG. 2 is a front view illustrating a dispenser 300 according to an embodiment of the present invention. In reference to FIG. 2, the structure of the dispenser 300 provided in the refrigerator which is the present invention will be described in detail.

As shown in FIG. 2, the dispenser 300 includes a dispenser case 310, a supply part 320, an opening/closing switch 330 and a power supply part 340.

Specifically, an accommodation space recessed a predetermined depth toward the inside of the freezer compartment door 200 may be provided in the dispenser case 310 to supply purified water or ice to a container such as a cup held by the user smoothly.

An operation panel 312 is provided in a proper area of the dispenser 300, and a display part and a button may be provided in the operation panel 312.

As a result, the user may check various pieces of information such as a temperature and a humidity inside the freezer or refrigerator compartments via the display part of the operation panel 312. The display part may be used to control the temperature and the humidity inside the freezer or refrigerator compartment based on the checked information.

In other words, the user uses the button provided in the operation panel 312 to control the operation of the refrigerator such that he or she may operate the inside of the freezer or refrigerator compartment to maintain a desired temperature and a desired humidity.

In the meanwhile, operational buttons 312*a* and 312*b* may be provided in the operation panel 312 to selectively supply an electric power to an external device which will be described later. The operational buttons are configured of an on-button 312*a* and an off-button 312*b*.

As a result, what the user has to do to supply the electric power to the external device or to cut off the power supply is only to push the on-button 312*a* or the off-button 312*b*.

The supply part 320 is provided in an upper area of the dispenser case 310 to supply water or ice and an end of the supply part 320 is exposed to the accommodation space.

The supply part 320 exhausts water purified in a purifier provided in the freezer or refrigerator compartment outside the refrigerator. After that, the user may receive the purified water in a container such as a cup.

As mentioned above, the supply part 320 may exhaust ice made in an ice maker as well as the purified water. If necessary, both of the purified water and the made ice may be exhausted by the supply part 320.

In the meanwhile, the opening/closing switch 330 may be provided in the accommodation space formed in the dispenser case 310, located under the supply part 320. The opening/closing switch 330 allows the purified water or the made ice to be supplied to the user by the supply part 320.

In other words, the user locates the container such as a cup under the supply part 320, and he or she presses the opening/closing switch 330 with the container. After that, the supply part 320 is opened and the purified water or the ice is supplied to the cup located under the supply part 320.

When the cup is detached from the opening/closing switch 330 after the purified water or the ice is supplied to the cup, the supply part 320 is closed and the supply of the purified water or the ice is stopped.

Here, the power supply part 340 configured to supply the electric power to the external device 400 may be provided under the opening/closing switch 330. It is preferable that the opening/closing switch 330 is a lever switch which is movable forward and backward.

It is preferable that the power supply part 340 is a receptacle including an electric access hole 342 which is ale to be connected with a terminal 410 provided in the external device 400. The structure and connection relation of the power supply part 340 will be described later.

Figure 3:
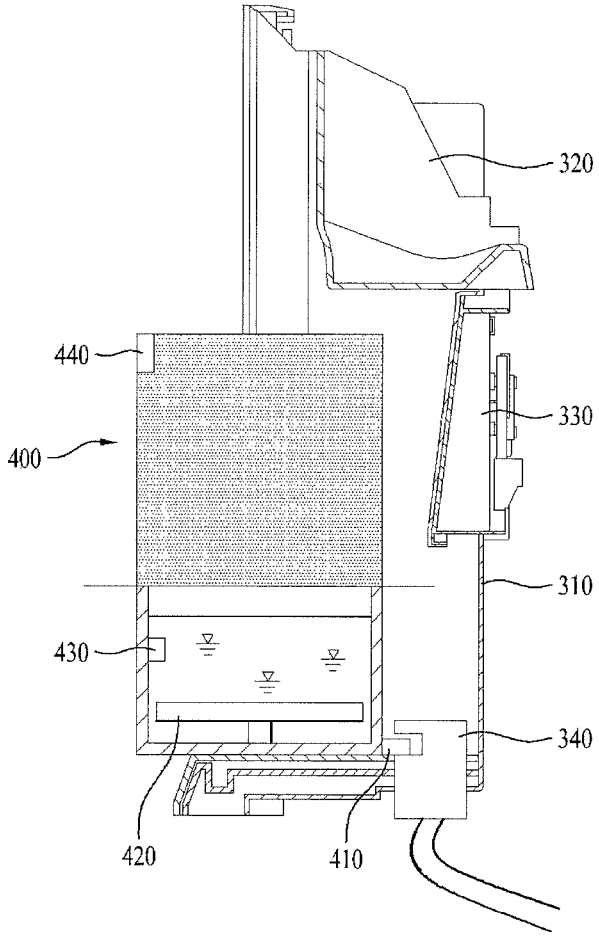
FIG. 3 is a side view illustrating a connecting relation between an external device and a power supply part of the dispenser according to the embodiment of the present invention.

FIG. 3 is a side view illustrating the relation between the power supply part 340 of the dispenser 300 and the external device 400. In reference to FIG. 4 will be described in detail a process of supplying hot water to the user after the user connecting the power supply part 340 of the dispenser 300 with the external device 400.

When trying to be supplied hot water to make coffee or tea, the user connects the external device 400 with the power supply part 340 provided in the dispenser 300. Here, the external device 400 is able to store and heat water.

For example, the user connects a terminal 410 provided in a coffee pot having a heating part 420 for heating liquid such as water with the power supply part 340, to heat the liquid contained in the coffee pot.

In other words, as shown in FIG. 3, the terminal 410 may be a plug provided in an outer surface of the coffee pot and the power supply part 340 may be a receptacle having an electric access hole 342 where the plug is plugged.

As a result, as soon as the coffee pot is seated on the dispenser case 310, the plug is plugged into the electric access hole 342 and the coffee pot is supplied the electric power by the power supply part 340, to heat the water contained therein.

In the meanwhile, when trying to connect the external power 400 with the power supply part 340 to heat the water, the operational process of the external device 400 via the operation panel 312 will be described.

When trying to heat the water, the user seats the external device 400 on the dispenser case 310.

Hence, the user presses the on-button 312*a* provided in the operation panel 312 and the electricity is then leading-in the external device 400. Because of that, the heating part 420 of the external device 400 is heated and the water is heated.

A sensor part 430 for measuring the temperature of water and a display lamp 440 for alarming completion of the heating may be provided in the external device 400.

When the sensor part 430 determines that the water contained in the external device 400 is heated to a preset temperature, the display lamp provided in the external device 400 is on and off to alarm the completion of the heating.

In the meanwhile, the electric power is supplied via the power supply part 340 and the terminal 410. Also, a signal for noticing the completion of the heating may be transported to the refrigerator from the external device 400.

At this time, the signal generated in the sensor part 430 is transported to the refrigerator. Once the heating is completed, the off-button 312*b* of the operation button is luminous to notice the completion of the heating.

The user recognizes the completion of the heating via the luminous off-button 312*b*. In this case, the user may separate the external device 400 from the power supply part 340 and he or she can be supplied hot water.

As a result, the user may be supplied not only the cold water from the dispenser 300 but also the hot water by connecting the external device 400 with the power supply part 340 provided in the dispenser 300. Subsidiary power supply parts may not be provided independently and use convenience may be enhanced accordingly.

In the meanwhile, when the trying to heat water by using the external device 400, water could be supplied to the external device 400 from an auxiliary water supply source provided independently. The user may press the opening/closing device 330 provided in the dispenser case 310 with the external device 400 held by the user, to receive water from the supply part 320. The external device 400 storing the water supplied by the supply part 320 is seated on the dispenser case 310 to heat the water.

As a result, the user can be supplied the water by the dispenser 300 to heat the water immediately, without using the auxiliary water supply source.

It is preferable that the terminal 410 is leading in and out from the external device 400. If the external device 400 is not used, the terminal 410 may be leading into the external device 400 to keep.

Figure 4:
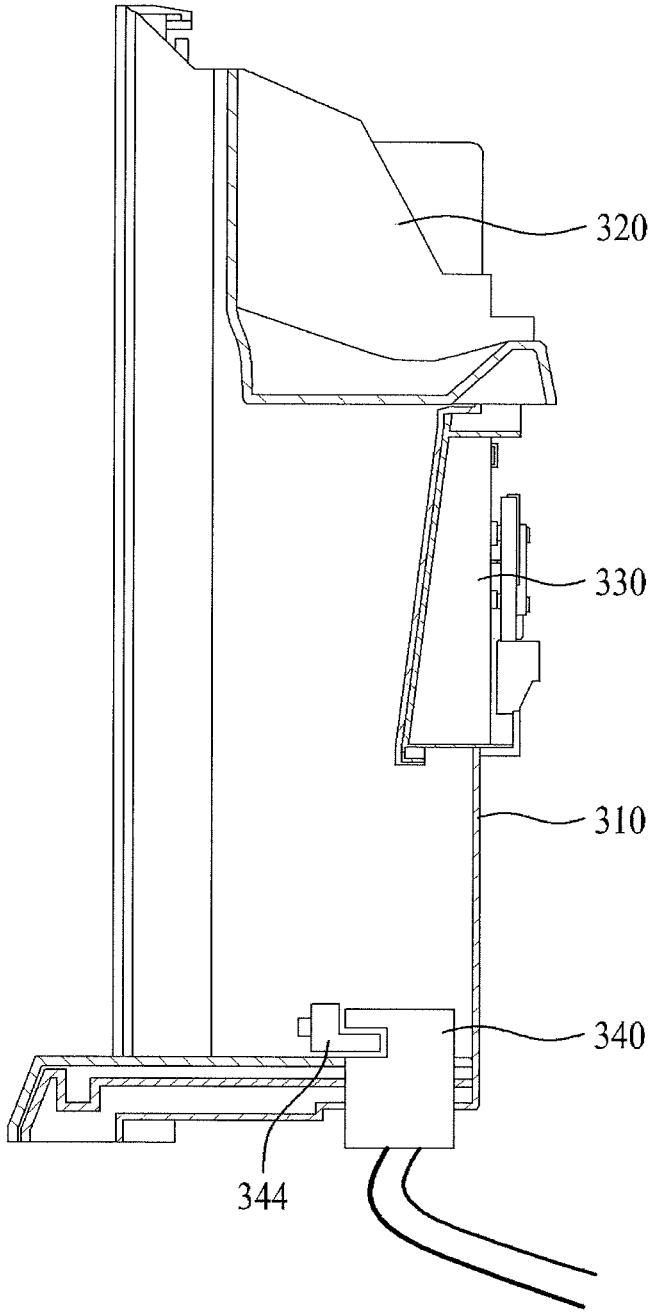
FIG. 4 is a side view illustrating a connecting relation between a cap and the power supply part of the dispenser according to the embodiment of the present invention.

FIG. 4 is a side view illustrating a relation between the power supply part 340 and a cap provided in the dispenser 300 according to the embodiment of the present invention. If not using the external device 400 for heating water, a cap 344 is coupled to the power supply part 340 to prevent danger such as an accident caused by a short circuit.

In other words, when the power supply part 340 provided in the dispenser case 310 is not used, the cap 344 is coupled to the electric access hole 342 of the power supply part 340 in which the terminal 410 is inserted.

A side of the cap 344 is formed in a corresponding shape to the inside of the electric access hole 342, to close the electric access hole 342. Because of that, water may be prevented from being drawn into the electric access hole 342 and the short circuit accident generated by the water drawn into the electric access hole 342 may be prevented.

When he or she trying to heat water, the user separates the cap 344 from the power supply part 340 to connect the external device 400 with the power supply part 340.

Figure 5:
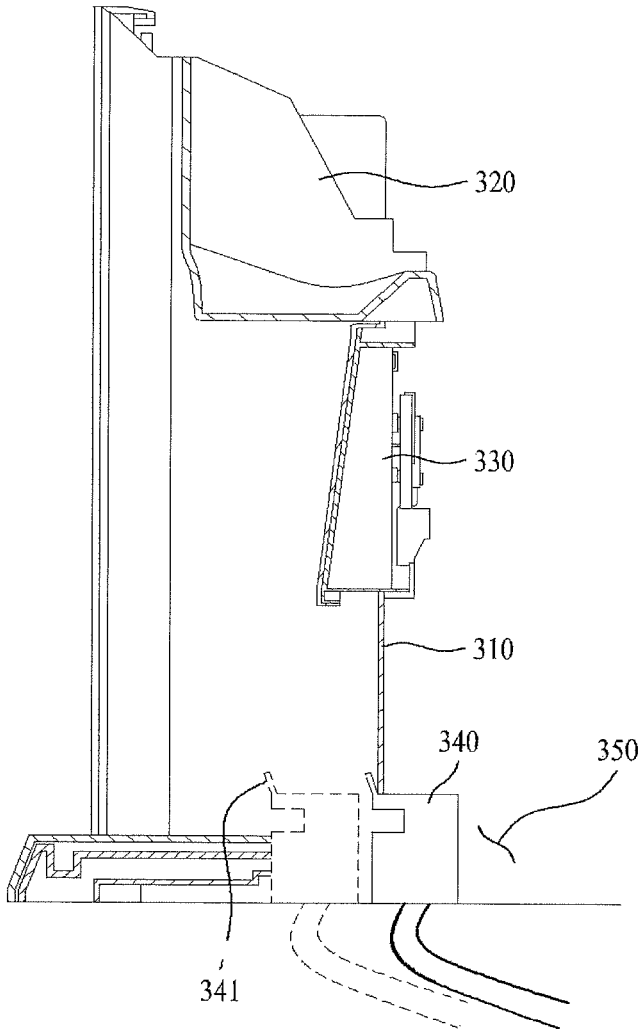
FIG. 5 is a side view illustrating an operational process of the power supply part of the dispenser according to the embodiment of the present invention.

FIG. 5 is a side view illustrating an operational process of the power supply part 340 provided in the dispenser 300 according to the embodiment of the present invention.

In reference to FIG. 5, when the external device 400 for heating water is not used, the power supply part 340 which is the receptacle is leading into the dispenser case 310 and the danger such as the short circuit accident may be prevented.

In other words, the power supply part 340 is provided adjacent to a lower area of the dispenser case 310 and it may be leading in and out from the dispenser case 310.

As a result, when the user trying to heat water by using the external device 400, the user may lead out the power supply part 340 from the dispenser case 310 to connect it with the external device 400.

When not using the power supply part 340, the user may lead the power supply part 340 into the dispenser case 310 of the dispenser 300 to prevent water from being drawn into the electric access hole 342.

At this time, the power supply part 340 may be sliding-movable in a lower portion of the dispenser case 310 provided in the dispenser 300 and an accommodating recess 350 may be provided in the lower portion of the dispenser case 310 provided in the dispenser 300 to accommodate the power supply part 340.

In the meanwhile, a hooking protrusion 341 may be provided at a top end of the power supply part 340 and the hooking protrusion 341 may be hooked to a top end of an entrance edge of the accommodating recess 350.

As a result, the hooking protrusion 341 may solve a problem of failing to lead out the power supply part 340 because it is accommodated in the recess 350 too much.

In addition, the user may pull the hooking protrusion 341 forwardly to expose it outside and the hooking protrusion 341 may be employed as a kind of handle.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A refrigerator comprising:

a cabinet comprising a storage compartment;

a door rotatably provided in the cabinet;

a dispenser provided in the door to supply water outside the door, the dispenser comprising a dispenser case and a power supply part which is configured to connect with an external device to supply electric power to the external device, an accommodating recess provided in a lower portion of the dispenser case, to accommodate the power supply part; and a hooking protrusion provided at a top end of the power supply part to hook the power supply part to an entrance edge of the accommodating recess when the power supply part is accommodated in the accommodating recess, wherein the external device comprises:

a terminal that receives the electric power supplied by the power supply part, the terminal being a plug which is able to lead in and out from the external device, and a heating part configured to heat water contained in the external device by using the electric power supplied via the terminal, wherein the power supply part is a receptacle comprising an electric access hole in which the plug is inserted to supply the electric power to the external device and the power supply part is configured to move in a sliding manner to be kept in the dispenser case or exposed outside.

2. The refrigerator as claimed in claim 1, wherein the power supply part comprises a cap configured to open and close the electric access hole selectively.

3. The refrigerator as claimed in claim 1, further comprising:

an operation panel provided in the door, wherein a power supply button is provided in the operation panel to allow the electric power to be supplied to the external device or to allow the electric power to be cut off.

4. A dispenser for a refrigerator comprising:

a dispenser case provided in a door of the refrigerator;

a supply part provided in the dispenser case to supply ice or water;

an opening/closing switch provided in the dispenser case to allow the ice or the water dispensed outside selectively;

a power supply part provided in a lower portion inside the dispenser case, the power supply part which is configured to connect with an external device to supply electric power to the external device, an accommodating recess provided in a lower portion of the dispenser case, to accommodate the power supply part; and a hooking protrusion provided at a top end of the power supply part to hook the power supply part to an entrance edge of the accommodating recess when the power supply part is accommodated in the accommodating recess, wherein the external device comprises:

a terminal that receives the electric power supplied by the power supply part, the terminal being a plug which is able to lead in and out from the external device, and a heating part configured to heat water contained in the external device by using the electric power supplied via the terminal, wherein the power supply part is a receptacle comprising an electric access hole in which the plug is inserted to supply the electric power to the electric kettle and the power supply part is configured to move in a sliding manner to be kept in the dispenser case or exposed outside.

5. The dispenser for the refrigerator as claimed in claim 4, wherein the power supply part comprises a cap configured to open and close the electric access hole selectively.

6. The dispenser for the refrigerator as claimed in claim 4, further comprising:

an operation panel provided in the door, wherein a power supply button is provided in the operation panel to allow the electric power to be supplied to the external device or to allow the electric power to be cut off.

* * * * *